US005967238A

United States Patent [19]

Pepi et al.

[11] Patent Number: 5,967,238

[45] Date of Patent: Oct. 19, 1999

[54] THERMALLY RESPONSIVE FRANGIBLE BULB

[76] Inventors: Jerome S. Pepi, 10 Kathy Dr., Foxboro, Mass. 02035; Stephen James Nettleship, 8 Birchwood Drive, Lower Peover, Knutsford, Cheshire WA16 9QJ, United Kingdom; Brian Ernest Daly, 18 The Heys, Reddish, Stockport, Cheshire, SK5 6XS, United Kingdom

[21] Appl. No.: 08/942,864

[22] Filed: Oct. 2, 1997

[30] Foreign Application Priority Data

Oct. 3, 1996 [GB] United Kingdom ..... 9620598

[51] Int. Cl.[6] ..... A62C 37/00; A62C 37/12; A62C 37/14

[52] U.S. Cl. ..... 169/37; 169/38; 169/42; 169/56; 169/57; 169/58

[58] Field of Search ..... 169/37, 38, 42, 169/56, 57, 58

[56] References Cited

U.S. PATENT DOCUMENTS

| | | | |
|---|---|---|---|
| 4,536,298 | 8/1985 | Kamei et al. | 169/46 X |
| 4,606,832 | 8/1986 | Hisamoto et al. | 169/47 X |
| 4,796,710 | 1/1989 | Job | 169/37 X |
| 4,938,294 | 7/1990 | Mohler et al. | 169/37 X |
| 4,981,179 | 1/1991 | Klein | 169/37 X |
| 4,993,496 | 2/1991 | Riedle et al. | 169/37 X |
| 5,219,474 | 6/1993 | Song et al. | 252/8 |
| 5,254,354 | 10/1993 | Stewart | 426/106 |
| 5,276,433 | 1/1994 | Booker et al. | 169/48 X |
| 5,585,028 | 12/1996 | Berger | 169/46 X |
| 5,789,494 | 8/1998 | Hand et al. | 525/453 |

*Primary Examiner*—Andres Kashnikow
*Assistant Examiner*—Robin O. Evans
*Attorney, Agent, or Firm*—Bergert & Bergert

[57] ABSTRACT

A thermally responsive frangible bulb containing a liquid which when heated expands to burst the bulb. In use the bulb may be positioned between a support and a sprinkler outlet cap such that when the bulb bursts the sprinkler outlet is opened. The bulb is at least partially filled with at least one halogen derivative of an aromatic hydrocarbon containing two or more halogen substituents such as 1,3-dichlorobenzene, or an aliphatic amide such a formamide. Use of these liquids enables a wide range of operating temperatures and a quick response operating time to be achieved.

7 Claims, 1 Drawing Sheet

THERMALLY RESPONSIVE FRANGIBLE BULB

Figure 2:
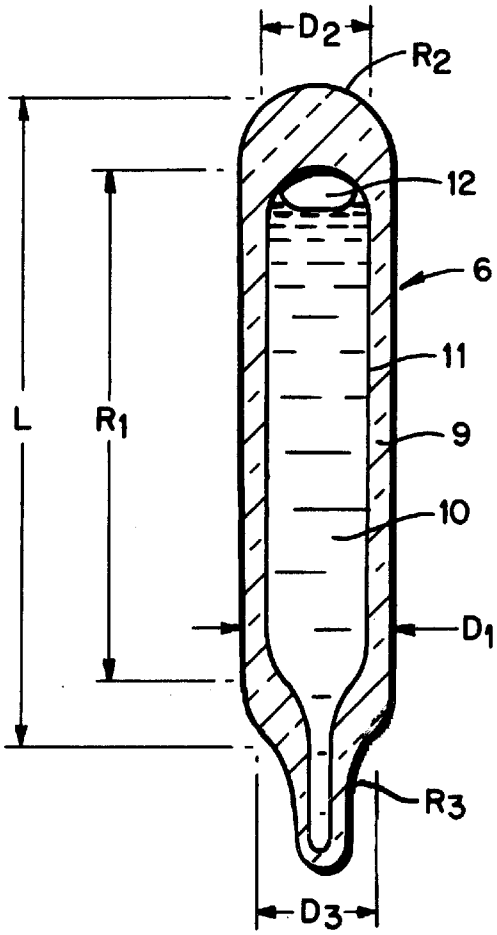

THIS INVENTION relates to a thermally responsive frangible bulb of the type used to automatically release quick response, fire protection sprinklers (nozzles) or, other types of thermally actuated devices.

Automatic fire sprinklers (nozzles) have a frame with an outlet at one end, an orifice which is usually just upstream of the outlet, and an inlet which is connectable to a source of fire retarding fluid under pressure. The outlet is secured in the normally closed or sealed position by a cap, the cap being held in place by a thermally responsive element which is releasable when its temperature is increased from a normal ambient condition to a value within a prescribed operating range, by the heat from a fire. Upon release of the thermally responsive element, a stream of fire retarding fluid rushes from the outlet towards a deflector, which is mounted on the frame at the opposite end from the outlet, and is distributed over the area to be protected by the sprinkler (nozzle) from fire.

The two primary types of thermally responsive elements used to automatically release fire sprinklers are fusible solder links and frangible glass bulbs. Automatic fire sprinklers were first commercially introduced in the 1870's with various types of fusible solder links. Although ultimately satisfactory, a great deal of effort went into the development of the fusible solder links to ensure, among other requirements, that they would: not creep apart, over time, at the normally expected ambient temperature conditions; not be deteriorated or corroded by the normally expected environmental conditions; release with a sharp, positive action; be thrown free of the sprinkler upon activation, so as to not interfere with the distribution of the fire retarding fluid; and, respond promptly to fire conditions.

The search for improvements to fusible solder links, which would achieve these requirements, ultimately led to the invention of frangible glass bulb elements, for use in automatic fire sprinklers, as exemplified and discussed in U.S. Pat. No. 654,188, U.S. Pat. No. 842,725 and U.S. Pat. No. 1,639,911. With general improvements in material, glass forming, as well as metal casting technology, it has been possible, within the last 20 years or so, to reduce the size of the frangible glass elements and the frames of automatic fire sprinklers, as initially typified by U.S. Pat. No. 4,121,665 and U.S. Pat. No. 4,167,974. However, the principles concerning the method of operation of frangible glass bulbs as well as the advantages of their use, in automatic fire sprinkler applications, have remained essentially the same. The inherent nature of frangible glass bulb elements not only addressed the above mentioned performance requirements for fusible solder links, and indeed for automatic fire sprinklers in general, at a low manufacturing cost for the thermally responsive element, they have also ultimately provided a ready means for automating the assembly of automatic fire sprinklers.

The successful use of frangible glass bulbs, as thermally responsive elements for automatic fire sprinklers, has comprised: particular strength, thermophysical, shape and dimensional requirements for the glass shell which forms the exterior of the bulbs; the need to have certain thermophysical properties for the liquid used to fill the glass shell; and the necessity for precise control over the extent to which the glass shell is filled with liquid prior to sealing. Some discussion of the required combinations of attributes are presented in U.S. Pat. Nos. 1,290,602, 1,290,762 and U.S. Pat. No. Re. 16,132. Although it has been found that sodium borosilicate glass is more preferable to quartz material for use in forming the shell of the bulbs, and other liquids have been found to be more preferable to the carbon tetrachloride initially used for filling the bulbs, the basic description of the operating cycle of frangible glass bulbs has remained substantially the same, as stated in the Third Edition of the Grinnell Company Inc. phamphlet *Grinnell Quarts Bulb Sprinkler* dated May 1929, that is > "The bulb is initially filled with a liquid, the remaining space being largely a bubble. The liquid used has been chosen because of its low freezing point, large co-efficient of (thermal) expansion, slight compressibility, low specific heat and the reluctance with which it retains air in solution. When the head (fire sprinkler) is exposed to rising temperature, the liquid expands and gradually the bubble decreases in size, the air being forced into solution because of the increasing pressure and in spite of the elevated temperature. Finally, all of the air becomes dissolved and the entire bulb is filled with the expanding liquid. When this occurs, an almost irresistible internal force is brought to bear on the walls of the bulb and fracture soon occurs. At the instant of rupture the pressure is suddenly decreased so that the air which has been held in solution is free to escape with a mildly explosive action which is sufficient to completely shatter the bulb even in spite of heavy loadings (due to the sprinkler assembly)."

In the publication "Sprechsaal", Volume 121, No. 9, 1988, criteria for selecting liquids for use in frangible bulbs for sprinklers are discussed in a paper entitled "Untersuchung der Einfluβgroōβon beim Bersten von Sprinklerampullen". Characteristics of a wide range of substances are set out in a list on page 786. The list in effect does no more than present values for pressure gradients of various liquids derived by calculation from publishes data, and a limited number of such values derived experimentally. The conclusion is reached that "only glycerine, ethylene glycol and polyethylene glycol can be considered" because of problems encountered with working with aniline, bromoform and di-iodine methane.

Starting in the early 1970's, research into the requirements for making further improvements in the safety to life benefits provided by automatic fire sprinkler systems demonstrated that safety to life could be substantially enhanced through the use of so-called "quick response" or "fast response" thermally responsive elements for the automatic fire sprinklers. Further research in the 1980's showed that property protection could also be enhanced by the use of the quick response elements. Up until the mid to late 1980's, fusible solder links had an advantage over frangible glass bulbs in that they could readily achieve the desired thermal sensitivity for quick response sprinklers through utilising links constructed of thin wall, high thermal conductivity metals joined by a thin bond of fusible solder. However, improvements in glass bulb formation machinery along with inventions concerning alternate formations for the shell of frangible glass bulbs, as described in U.S. Pat. No. 4,796,710 and U.S. Pat. No. 4,993,496 have provided the means for achieving the structural attributes needed for them to be able to provide quick response operating characteristics. In addition, when combined with the use of more thermophysically responsive liquids, frangible glass bulbs have been able to be produced with the thermal sensitivity requirements for quick response sprinklers, as described below.

Since the invention of the frangible glass bulb sprinkler, various types of liquids have been used for filling the bulbs, such as: mercury, carbon tectrachloride, alcohol, tetrachloroethane, acetone, amyl acetate, triethylene glycol, glycol diacetate, ethylene glycol, glycerol, and other dielectric fluids commonly used for heat transfer applications. However, these types of fluids do not offer the combination of properties needed to achieve quick response operating characteristics as well as low Hazard Ratings in cost effective frangible glass bulbs having a nominal operating temperature rating of at least up to 93° C. and, preferably at least up to 141° C.

Initially, trichloromethane was used for the filling of quick response, frangible glass bulbs, but more recently liquids such as tetrachloroethylene (perchloroethylene) as described in U.S. Pat. No. 4,938,294 have been used to fill bulbs having a nominal operating temperature rating of up to 93° C. Because the boiling point of the tetrachloroethylene liquid is about 121° C., it is not generally suitable for use in filling the subsequently developed quick response, frangible glass bulbs having a nominal operating temperature rating of up to 93° C. Because of the boiling point of the tetrachloroethylene liquid is about 121° C., it is not generally suitable for use in filling the subsequently developed quick response, frangible glass bulbs having a nominal operating temperature rating of 141° C. and other liquids have been used exclusively for filling high temperature bulbs.

It is an object of the invention to provide an improved thermally responsive frangible bulb.

According to the invention, there is provided a thermally responsive frangible bulb comprising a shell defining a closed interior space containing a liquid which expands to fill the space and fracture the bulb when heated to within a pre-determined temperature range, wherein the liquid comprises at least one member from either of the chemical groups consisting of derivatives of aromatic hydrocarbons containing two or more halogen substituents and aliphatic amides.

Although the technical choice of suitable liquids for fast response sprinkler bulbs has been based on consideration of thermophysical properties such as compressibility, thermal expansivity and thermal conductivity, for example as described in U.S. Pat. No. 4,938,294, the data available for candidate liquids is sparse, often dubious and rarely in the pressure/temperature regime of a sprinkler bulb at operation. It is not possible to accurately predict performance as a bulb filling liquid based on incomplete or contentious literature values. Practically no independent empirical measures exist of important liquid properties such as the dP/dT ratio which defines the relationship between bulb operating temperature and sensitivity. The choice of the most suitable liquid depends on an extensive empirical testing programme where the thermophysical factors outlined above will indicate, but not exclude candidate substances. Examples of liquids assessed by this approach are shown in Table 1. In addition, consideration should be made of factors such as melting and boiling points, long term stability, flammability, toxicity and cost and availability of liquids.

TABLE 1

Thermophysical Properties of Expanding Liquids

| Substance | Boiling Point (° C.) | Density (g/cm) | Heat Capacity (J/° K./cm$^3$) | Thermal Conductivity (W/m/° K.) | Thermal Expansion (cm/° K.) | dP/dT (measured) (Bar/° K.) |
|---|---|---|---|---|---|---|
| 1,2 Dibromobenzene | 224 | 1.956 | 1.54 | | | 12.51 |
| 1,3 Dichlorobenzene | 173 | 1.28 | 1.4 | 0.13 | 0.00094 | 11.20 |
| 1,3 Dioxolane | 74 | 1.06 | | | | 13.11 |
| 1 Bromo 3 Chlorobenzene | 196 | 1.63 | 1.47 | | | 11.79 |
| Cyclohexane | 81 | 0.779 | 1.4 | 0.12 | 0.0018 | 9.17 |
| Formamide | 210 | 1.134 | | | | 15.22 |
| N,N Dimethylformamide | 153 | 0.944 | 1.9 | | 0.00104 | 13.82 |
| Propanone (Acetone) | 56 | 0.791 | 1.69 | 0.16 | 0.00149 | |
| Tetrachloroethylene | 121 | 1.61 | 1.38 | 0.11 | 0.00102 | 11.22 |

By means of detailed experimental analysis the desirable properties for performance can be correlated with the chemical structure in terms of specific combinations of functional groups, and identification of a suitable liquid can be narrowed down to members of chemical structure classes. A preferred filling liquid comprises a member of the group of halogenated aromatic hydrocarbons containing two or more halogen substituents, or of the group aliphatic amides.

Preferably, the halogenated aromatic hydrocarbon is benzene for which two or more hydrogens are substituted by a halogen, such as 1,3 dibromobenzene illustrated below.

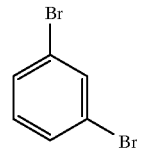

1,3 dibromobenzene

The above is an example of a Hûckel aromatic hydrocarbon, containing 2n+2π electrons, with two halogen groups bound directly to the aromatic ring. The halogen may be selected from bromine, chlorine or fluorine, for example, 1,2-dichlorobenzene, 1,3-dichlorobenzene, 1,2-dibromobenzene, 1-bromo-2-chlorobenzene, 1-bromo-2-fluorobenzene, 1-bromo-4-fluorobenzene, 1-chloro-2-fluorobenzene, 1-chloro-4-fluorobenzen, 1,2,4-dichlorobenzene, 1-bromo-2,4,5-trifluorobenzene, 1,3-dichloro-2,5-difluorobenzene or a mixture of any two or more of the above halogen derivatives.

Compounds containing the amide group such as formamide N,N dimethylformamide, N,N-dimethylacetamide and N-methylformamide possess relevant functionality for use in liquids for trigger elements N,N-dimethylacetamide is illustrated below and is an example of the aliphatic amide group, containing the amide linkage (—C(O)N—).

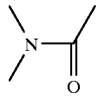

N,N-dimethylacetamide

In combination with satisfying sensitivity requirements to fast response standard, the present invention bestows a number of advantageous properties. These include benefits to the manufacturer of low scrap wastage due to high values of dP/dT ratio, greater predictability of properties and performance across an extended range of temperature ratings and more efficient manufacturing processes and hazard analysis for manufacturers and end users and use in sub zero environments where temperatures approach −50° C. or less for extended periods. The liquids contained in the glass bulbs are readily available and represent a reduced level of toxicity in comparison with previously used substances, some of which, such as carbon tetrachloride and trichloroethane, have at this date been banned for many applications.

Figure 1:
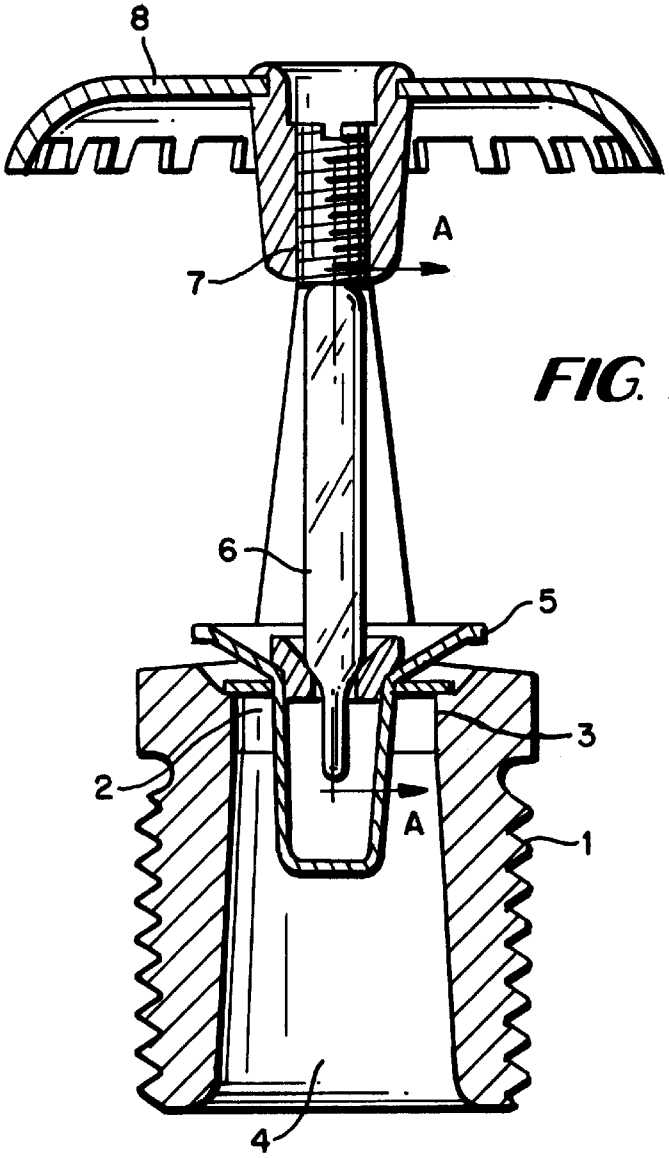

An embodiment of the invention will now be described, by way of example, with reference to the accompanying drawings, in which:

FIG. 1 is a partial sectional view of an automatic fire sprinkler showing a preferred embodiment of the quick response, frangible glass bulb, thermally responsive element of this invention;

and FIG. 2 is an enlarged, axial, cross-sectional view of the quick response, frangible glass bulb of this invention taken along the line A—A of FIG. 1.

With reference to FIG. 1, automatic fire sprinklers (nozzles) of this invention have a frame 1 with an outlet 2 at one end, an orifice 3 which is usually just upstream of the outlet 2, and an inlet 4 which is connectable to a source of fire retarding fluid under pressure. The outlet 2 is secured in the normally closed or sealed position by a cap 5, the cap 5 being held in place by a thermally responsive element 6 which is secured in position by bulb assembly screw 7 and releasable when its temperature is increased from a normal ambient condition to a value within a prescribed operating range, by the heat from a fire. Upon release of the thermally responsive element 6, a stream of fire retarding fluid rushes from the outlet towards a deflector 8, which is connected to the frame 1 at the opposite end from the outlet 2, and is distributed over the area to be protected by the sprinkler (nozzle) from fire.

With reference to FIGS. 1 and 2, the thermally responsive element 6 of this invention is comprised of a frangible glass bulb being itself comprises of a shell 9 and a liquid 10 which, in the room temperature state, nearly completely fills the interior space 11 of the shell 9, except for a relatively small glass pocket 12. With further reference to FIG. 2, the shell 9 of the frangible glass bulb of this invention consists of a central region $R_1$ which has a uniform outer diameter $D_1$, a spherical end region $R_2$, and a stem end region $R_3$, the spherical end region having a seat of diameter $D_2$ and the stem end region having a seat of diameter $D_3$, the distance between the spherical end seat and the stem end seat being length L.

In the preferred embodiment of this invention, the frangible glass bulb 6 is of the quick response type with a diameter $D_1$ of from about 2 mm to about 3 mm, a diameter $D_2$ of up to about 2.5 mm, a diameter $D_3$ of up to about 2.2 mm, and a length L of from about 12 mm to about 24 mm, the diameters $D_2$ and $D_3$ being in proportion to diameter $D_1$. The liquid 9 which nearly completely fills the shell 8 of the frangible glass bulb 6 is 1,3-dichlorobenzene.

The frangible glass bulb described above has been found to have the combination of thermophysical properties needed to meet all known prescribed operating temperature range, functionality, and maximum RTI requirements for automatic fire sprinklers, as well as, provide a boiling point well above that necessary to fill at least up to 141° C. nominal operating temperature rating frangible glass bulbs, in addition to, providing a desirable reduction in Health Hazard and Contact Hazard Ratings.

We claim:

1. A thermally responsive frangible bulb comprising a shell defining a closed interior space containing a liquid which expands to fill the space and fracture the bulb when heated to within a predetermined temperature range, wherein the liquid is selected from the group comprising at least one halogen derivative of an aromatic hydrocarbon containing two or more halogen substituents, an aliphatic amide, and a mixture thereof.

2. A frangible bulb according to claim 1, wherein the liquid is 1,3-dichlorobenzene.

3. A frangible bulb according to claim 1, wherein the liquid is 1,2,4-dichlorobenzene.

4. A frangible bulb according to claim 1, wherein the liquid is 1-bromo-2,4,5-trifluorobenzene.

5. A frangible bulb according to claim 1, wherein the liquid is an aliphatic amide, selected from the group consisting of N,N-dimethylformamide, N,N-dimethylacetamide, and N-methylformamide formamide.

6. A frangible bulb according to claim 1, wherein the liquid is a mixture of any two or more of the compounds 1,3-dichlorobenzene; 1,2,4-dichlorobenzene; 1-bromo-2,4,5-trifluorobenzene; N, N-dimethylformamide; N,N-dimethylacetamide; N-methylformamide.

7. An automatic fire sprinkler having an inlet which in use is connected to a source of fire retarding fluid under pressure, and an outlet which is secured in the normally closed or sealed condition by a thermally responsive frangible bulb as defined in claim 1.

* * * * *